US011535285B2

(12) United States Patent
Puszkarz et al.

(10) Patent No.: US 11,535,285 B2
(45) Date of Patent: Dec. 27, 2022

(54) ARTICULATED COUPLING, CONICAL THREADED RING, METHOD FOR THE PRODUCTION OF A MOUNTING OF A CUTTING TOOL WHICH MOUNTING CAN DISENGAGE WHEN OVERLOADED, AS WELL AS A METHOD FOR ENERGY CONVERSION BY MEANS OF AN ARTICULATED COUPLING

(71) Applicant: Axtone S.A., Kanczuga (PL)

(72) Inventors: Krzysztof Puszkarz, Przeworsk (PL); Jan Kukulski, Kosina (PL); Leszek Wasilewski, Gniewczyna (PL); Miroslaw Sum, Przeworsk (PL)

(73) Assignee: Axtone S.A., Kanczuga (PL)

( * ) Notice: Subject to any disclaimer, the term of this patent is extended or adjusted under 35 U.S.C. 154(b) by 435 days.

(21) Appl. No.: 16/637,820

(22) PCT Filed: Aug. 10, 2018

(86) PCT No.: PCT/EP2018/071739
§ 371 (c)(1),
(2) Date: Feb. 10, 2020

(87) PCT Pub. No.: WO2019/030374
PCT Pub. Date: Feb. 14, 2019

(65) Prior Publication Data

US 2020/0283034 A1 Sep. 10, 2020

(30) Foreign Application Priority Data

Aug. 11, 2017 (DE) ..... 10 2017 007 591.3
Jan. 18, 2018 (DE) ..... 10 2018 101 043.5

(51) Int. Cl.
*B61G 11/16* (2006.01)
*B61D 3/10* (2006.01)
(Continued)

(52) U.S. Cl.
CPC ..... *B61G 11/16* (2013.01); *B61D 3/10* (2013.01); *B61D 15/06* (2013.01); *B61G 5/02* (2013.01); *B61G 7/08* (2013.01)

(58) Field of Classification Search
CPC ... B61G 5/00; B61G 5/02; B61G 7/08; B61G 9/00; B61G 9/04; B61G 9/10;
(Continued)

(56) References Cited

U.S. PATENT DOCUMENTS 1,499,873 A 7/1924 Leopold
4,341,394 A 7/1982 Cabeza
(Continued)

FOREIGN PATENT DOCUMENTS

CA 2973546 C * 9/2019 ..... B61G 11/16
CN 102180182 A * 9/2011
(Continued)

OTHER PUBLICATIONS

International Search Report and Written Opinion for International Application No. PCT/EP2018/071739 dated Nov. 21, 2018, pp. 13.

*Primary Examiner* — S. Joseph Morano
*Assistant Examiner* — Cheng Lin
(74) *Attorney, Agent, or Firm* — Mannava & Kang, P.C.

(57) ABSTRACT

The invention relates to an articulated coupling comprising at least one tension-transferring or compression-transferring rod, at least one pressure plate comprising a cutting tool that comprises at least one blade and a central conically shaped recess. Furthermore, the articulated coupling comprises at least one conical threaded ring which comprises an internal thread and is slit in a longitudinal direction, wherein the rod comprises an external thread onto which the conical threaded ring is screwed. The cutting tool is arranged on a conical external surface of the conical threaded ring,
(Continued)

Figure 1:
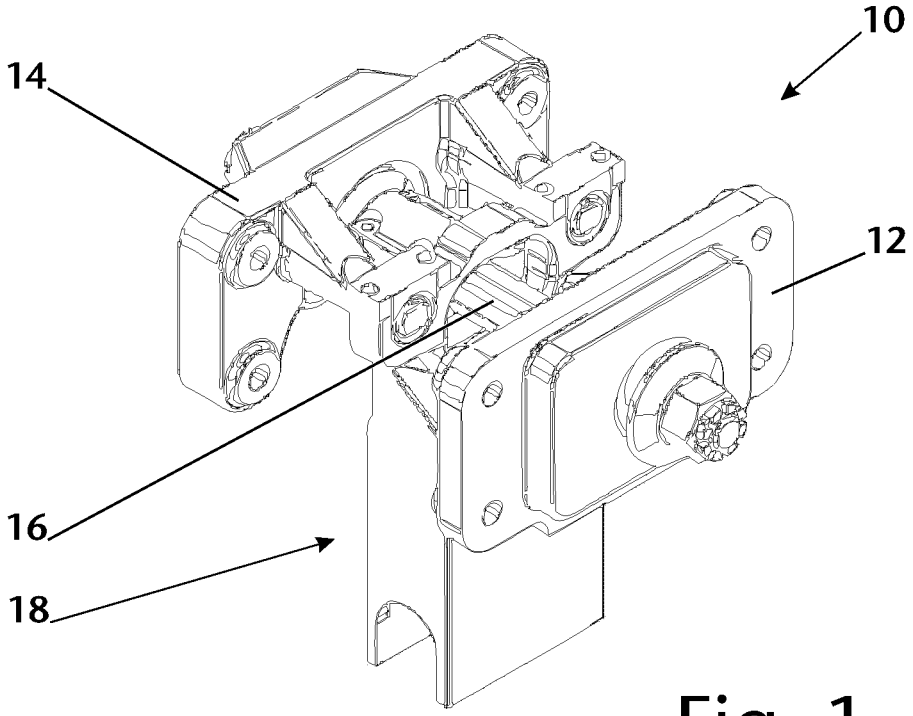

wherein the conical threaded ring is arranged at least partially in the conically shaped recess.

17 Claims, 4 Drawing Sheets

(51) Int. Cl.
*B61D 15/06* (2006.01)
*B61G 5/02* (2006.01)
*B61G 7/08* (2006.01)

(58) Field of Classification Search
CPC ..... B61G 11/00; B61G 11/14; B61G 11/16; B61G 11/18; B61D 3/10; B61D 15/06; F16F 7/12; F16F 7/125; F16F 7/126
See application file for complete search history.

(56) References Cited

U.S. PATENT DOCUMENTS

| | | | | |
|---|---|---|---|---|
| 4,346,795 | A * | 8/1982 | Herbert | B61G 9/10 293/133 |
| 7,410,069 | B2 * | 8/2008 | Hogbring | B61G 7/10 213/50 |
| 7,537,127 | B2 * | 5/2009 | Hogbring | B61G 9/22 213/50 |
| 9,328,749 | B2 * | 5/2016 | Brunneke | F16C 11/0695 |
| 10,988,149 | B2 * | 4/2021 | Lizell | B61G 11/16 |
| 2009/0008963 | A1 * | 1/2009 | Lindner | B61G 11/16 296/187.03 |
| 2011/0243647 | A1 | 10/2011 | Sohn | |
| 2016/0208843 | A1 | 7/2016 | Fabre et al. | |

FOREIGN PATENT DOCUMENTS

| | | | | |
|---|---|---|---|---|
| CN | 102180182 | A | 9/2011 | |
| CN | 202207724 | U | 5/2012 | |
| DE | 102012214764 | A1 | 2/2014 | |
| EP | 0536844 | A1 | 4/1993 | |
| EP | 1884434 | | 2/2008 | |
| EP | 1884434 | A1 * | 2/2008 | B61D 15/06 |
| PL | 222620 | B1 | 8/2016 | |
| RU | 2254270 | C2 | 6/2005 | |
| WO | 2016000601 | | 1/2016 | |
| WO | 2016139596 | A1 | 9/2016 | |

* cited by examiner

ARTICULATED COUPLING, CONICAL THREADED RING, METHOD FOR THE PRODUCTION OF A MOUNTING OF A CUTTING TOOL WHICH MOUNTING CAN DISENGAGE WHEN OVERLOADED, AS WELL AS A METHOD FOR ENERGY CONVERSION BY MEANS OF AN ARTICULATED COUPLING

CROSS-REFERENCE TO RELATED APPLICATIONS

The present application is a U.S. National Stage filing under 35 U.S.C. §371 of International Application PCT/EP2018/071739, filed Aug. 10, 2018 and entitled "ARTICULATED COUPLING, CONICAL THREADED RING, METHOD FOR THE PRODUCTION OF A MOUNTING OF A CUTTING TOOL WHICH MOUNTING CAN DISENGAGE WHEN OVERLOADED, AS WELL AS A METHOD FOR ENERGY CONVERSION BY MEANS OF AN ARTICULATED COUPLING" , which claims priority from German applications: App. Number 10 2017 007 591.3 filed Aug. 11, 2017 and App. Number 10 2018 101 043.5 filed Jan. 18, 2018. The International Application, including any appendices or attachments thereof, is incorporated by reference herein in its entirety.

The invention relates to an articulated coupling comprising at least one tension-transferring and/or pressure-transferring rod, a conical threaded ring, a method for the production of a mounting of a cutting tool on a tension-transferring or pressure-transferring rod, which mounting can disengage when overloaded, as well as a method for energy conversion by means of an articulated coupling.

Articulated couplings for connecting two railcar bodies of a rail vehicle are generally known from prior art. For example, EP 1 884 434 B1 describes an articulated coupling for the articulated connection of two adjacent railcar bodies of a rail vehicle, in particular in interaction with a truck.

The known articulated couplings with deformation elements for conversion of movement energies in the event of an accident normally have a high weight. Furthermore, with the known articulated couplings with deformation elements, a start of an energy conversion by dint of a deformation of elements provided for this purpose can be only set inadequately. In particular, with the articulated couplings known from prior art, cascading energy conversion elements, which under different forces are supposed to act on the articulated coupling, or deformation elements which already cause deformations under forces that are usual during operation, cannot be adjusted in relation to an initial force which causes the deformation.

It is the object of the invention to provide an improved articulated coupling. In particular, the object is to avoid the disadvantages known from prior art.

The object is solved according to the invention by means of an articulated coupling according to claim 1, a conical threaded ring according to claim 6, a method according to claim 8 for the production of a mounting of a cutting tool, which mounting can disengage when overloaded, as well as a method according to claim 9 for energy conversion by means of an articulated coupling. Further advantageous embodiments are to be learned from the following description, the figures, and the dependent claims. However, the individual features of the described embodiments are not limited thereto, but rather may be linked to each another and to other features to form further embodiments.

The object is accomplished by means of an articulated coupling comprising at least one tension-transferring or compression-transferring rod, at least one pressure plate comprising a cutting tool that comprises at least one blade and a central conically shaped recess. Furthermore, the articulated coupling comprises at least one conical threaded ring which comprises an internal thread and is slit in a longitudinal direction, wherein the rod comprises an external thread onto which the conical threaded ring is screwed. The cutting tool is arranged on a conical external surface of the conical threaded ring, wherein the conical threaded ring is arranged at least partially in the conically shaped recess.

The articulated coupling may preferably be arranged between two cars of a rail vehicle. More preferably, the articulated coupling comprises at least two opposing connection plates. More preferably, one connection plate in each case may be arranged on one car.

In an embodiment, it is provided that connection plates are connected to one another by means of a rod, wherein the rod is divided in two in a further embodiment. In an embodiment, it is provided that a cutting tool which has blades is arranged on the rod. In an embodiment, it is provided that the cutting tool is mounted on the rod and, in particular, pressed into the connection plate and additionally secured on the rod by means of the conical threaded ring. In an embodiment, it is provided that, in the case of tensile or compressive loads from the connection plate, forces are transferred into the rod via rubber buffers which dampen the smaller impacts. In an embodiment, it is provided that forces acting on the connection plate are transferred to the rod via the rubber buffers, the cutting tool and the conical threaded ring.

In an intended operation, as well as in the event of an accident, a force is applied by the railcar body to the connection plate. Tensile and/or compressive forces are preferably transferred by the connection plate directly or indirectly to the cutting tool. In particular, in an intended operation, the forces are additionally or alternatively introduced into the rod via the conical threaded ring. The articulated coupling according to the invention has the advantage that in the case of an overload, for example in an accident, the conical threaded ring can disengage from the rod, or be translationally movable on the rod. The conical threaded ring can expand due to the slit and, with a predetermined application of force, slide over the thread. In particular, the force with which an initial movement of the cutting tool with respect to the rod occurs may be adjusted by means of the threaded ring. Furthermore, provided that the conical threaded ring is located over at least one part of the outer thread of the rod, at least a preferably adjustable frictional resistance will brake the movement of the cutting tool with respect to the rod by dint of a sliding of the threads over each other.

Within the meaning of the invention, the "intended operation" is a use of the articulated coupling as articulated coupling, in particular, between two railcar bodies of a train. By contrast, an "overload" exists in particular if, for example, by reason of an accident a force is applied to the articulated coupling, which force in particular is greater than a maximum force which occurs, for example in driving mode, when shunting or coupling railcar bodies.

In an embodiment, it is provided that the articulated coupling comprises two opposing connection plates, which may be attached to railcar bodies of a rail vehicle. In an embodiment, it is provided that the articulated coupling comprises a rod which connects the connection plates to one another. In an embodiment, it is provided that the articulated coupling is a coupling component, for example a coupling component of a Jacobs bogie. The cutting tool is preferably pressed into the pressure plate. In particular, cutting tool and pressure plate have a force-fitting connection. In a further embodiment, it is provided that the cutting tool has in addition to or as an alternative to a force-fitting connection, a form-fitting connection and/or flush-fitting connection to the pressure plate. In particular, at least the pressure plate with the cutting tool forms a stem part that can be mounted with the rod. In a further embodiment, it is provided that the pressure plate comprises the cutting tool.

In an embodiment, the articulated coupling comprises two opposing pressure plates. In a further embodiment, it is provided that only one pressure plate comprises a cutting tool, or acts together with it. In a further embodiment, it is provided that both pressure plates comprise a cutting tool or act together with it.

In an embodiment, it is provided that the articulated coupling has a pressure plate, more preferably two pressure plates with a cutting tool. The pressure plates are preferably assigned to opposite ends of the rod.

The conical threaded ring is slit in the longitudinal direction. Within the meaning of the invention, a slit is a continuous elongated recess. The slit preferably extends over the entire longitudinal extension of the conical threaded ring. The slit is preferably designed radially. In a further embodiment, it is provided that the slit is designed along a secant of a cross-section of the conical threaded ring. The conical threaded ring is preferably executed such that it is designed to be expandable. The slit preferably has a width of approximately 0.5 mm to approximately 3 mm, preferably approximately 1 mm to approximately 2 mm.

If the term "approximately" is used in connection with values or value ranges within the scope of the invention, what is to be understood by this is a tolerance range which the person skilled in the art in this field considers to be typical; in particular, a tolerance range of ±20%, preferably ±10%, more preferably ±5% is provided.

In one embodiment, the rod is designed as a pull rod and/or push rod. In a further embodiment, the rod is designed to be at least partially hollow. In a further embodiment, the rod is designed in two parts, in particular in the form of two rod parts arranged one behind the other in the longitudinal direction of the rod. In particular, a bifurcation of the rod is advantageously provided for a mounting and/or dismantling of the articulated coupling. In a further embodimeat, the rod is at least partially round in cross-section. In a further embodiment, the rod is designed to be at least partially essentially rectangular in cross-section.

The term "essentially" indicates a tolerance range that is to be understood by the person skilled in the art from economic and technical points of view so that the corresponding feature is still recognized or realized as such.

The cutting tool is preferably designed as an annular component. In a further embodiment, the cutting tool is inserted into, preferably pressed into, the pressure plate. In an embodiment it is provided that the cutting tool comprises approximately 1 to approximately 20 cutting tools, more preferably approximately 3 to approximately 8 cutting tools, more preferably approximately 8 cutting tools. The cutting tool is preferably arranged such that upon displacement of the cutting tool on the rod, the rod can be deformed, and preferably at least a chip can be removed from the rod in the event of an energy input.

In an embodiment, the rod has a recess, for example a groove, more preferably an annular groove, in which the cutting tool engages. In an embodiment, it is provided that the cuffing tool, in particular during mounting, is pressed into the material of the rod. In a further embodiment, the cutting tool in an intended operation of the articulated coupling, in particular the blades of the same, does not touch the rod. In an embodiment, the rod has at least a conical section. In a further embodiment, it is provided that the cutting tool is arranged in the region of a minor diameter of a conical section of the rod. The cutting tool is more preferably an in particular annular component, which at least partially encloses the rod. In an embodiment, it is provided that the cutting tool during normal operation is held on the rod by the conical threaded ring. In a further embodiment, it is provided that during normal operation the cutting tool is arranged in such a way on the rod that at least one blade touches the rod or at least partially engages with the material of the rod.

In a further embodiment, it is provided that the outer surface of the conical threaded ring and the recess of the cutting tool essentially have an identical conicity. More preferably, the recess and the conical threaded ring have essentially the same longitudinal extension. In a further embodiment, it is provided that a longitudinal extension of the recess is longer than a longitudinal extension of the conical threaded ring. In a further embodiment, it is provided that a longitudinal extension of the conical threaded ring is longer than a longitudinal extension of the recess.

In an embodiment, it is provided that a conical threaded ring with a minor diameter, which is assigned to a top surface, and a major diameter opposed in a longitudinal direction, which is assigned to a base surface, is provided. In an embodiment, it is provided that the conical threaded ring has an internal thread. In an embodiment, it is provided that the outer surface of the conical threaded ring in the longitudinal direction has a conical and essentially smooth or unprofiled design. In an embodiment, it is provided that the conical threaded ring has a radial slit, which extends over the entire length of the conical threaded ring.

In an embodiment, it is provided that the slit allows an expansion of the conical threaded ring.

In an embodiment, at least two handling openings are provided in which a tool may engage in order to mount the conical threaded ring on the rod.

An advantage of this embodiment is that the conical threaded ring can be inserted to fit precisely into the recess of the cutting tool. In a further embodiment, the conical threaded ring is pressed into the recess of the cutting tool.

In an embodiment, it is provided that the conical threaded ring is arranged in the recess of the cutting tool such that the conicity of the recess and of the conical threaded ring is the same, wherein a minor diameter of the recess is smaller than the minor diameter of the conical threaded ring. In a further embodiment, it is provided that the minor diameter of the recess is essentially the same size as the minor diameter of the conical threaded ring. In an embodiment, it is provided that the outer diameter of the conical threaded ring and the recess taper in the direction of the blades. In an embodiment, it is provided that the conical threaded ring can be pressed into the cutting tool, wherein in particular a pretensioning of the conical threaded ring may be produced and therefore a force-fitting connection is created between the conical threaded ring and the cutting tool. In an embodiment, it is provided that the external thread of the rod interacts with the internal thread of the conical threaded ring.

In the context of the invention, the term "conicity" is the change in the diameter of a cone along its length. In particular, a cone has a major diameter and an opposing minor diameter, wherein the major diameter is assigned to a base surface and the minor diameter to a top surface of a truncated cone enclosing the cone.

In a further embodiment, it is provided that the conical threaded ring is screwed onto the thread of the rod, wherein the conical threaded ring is preferably guided into the recess by means of screws where it is press-fitted.

In a further embodiment, it is provided that the internal thread of the conical threaded ring is metric. In a further embodiment, it is provided that that the external thread of the rod is metric. Rod and conical threaded ring preferably have threads that correspond to each another. In a further embodiment, it is provided that the internal thread of the conical threaded ring and/or the external thread of the rod is a V-thread or a buttress thread. It is particularly preferred that a flank angle of a V-thread is approximately 50° to approximately 90°, more preferably approximately 60°. In a further embodiment, a thread flank of a buttress thread is inclined vertically more than approximately 30°, in particular approximately 30° to approximately 60°, with respect to the longitudinal direction.

In an embodiment, it is provided that in the event of an overload input the external thread of the rod slides over the internal thread of the conical threaded ring, wherein in an embodiment this may be expanded by the slit. In an embodiment, it is provided that the rod is designed to be movable relative to the cutting tool. In an embodiment, it is provided that by means of the blades at least one chip respectively may be removable from the rod. In an embodiment, it is provided that through the deformation work that is performed by the cutting tool, an energy conversion is completed and, in particular, the kinetic energy is converted to heat and deformation energy. In an embodiment, it is provided that during normal operation smaller impacts are absorbed by means of the rubber buffers and, in particular, do not lead to the threaded connection disengaging from rod and conical threaded ring.

From prior art it is only known to provide trapezoidal threads to securely hold connections of rods subjected to tension and compression to further components. A V-thread and/or buttress thread, preferably a metric thread, has the advantage over a trapezoidal thread that the conical threaded ring may slide on the thread flanks in the event of overload. In particular, the conical threaded ring is expandable, in particular by means of the slit, in the case of a translational sliding of the thread flanks over each other. In the case of overload, the conical threaded ring may, in particular without rotation, slide or jump in a translational manner from thread to thread. In particular, the conical threaded ring in the case of overload is preferably destroyed or damaged by means of the translational movement of the threads with respect to one another. In an embodiment, it is provided that the conical threaded ring is no longer movable on the rod once the thread of the conical threaded ring and/or of the rod is at least partially destroyed. In a further embodiment, it is provided that with an at least partial destruction of the thread of the conical threaded ring and/or of the rod, the conical threaded ring can continue to move on the rod.

In an embodiment, it is provided that the conical threaded ring is arranged in a recess of the cutting tool. In an embodiment, it is provided that the blades of the cutting tool touch the rod, however, in particular do not perform any deformation work on said rod, provided that the cutting tool or the conical threaded ring is held on the rod by means of the threaded connection. In an embodiment, it is provided that the connection plate acts via the rubber buffer on the cutting tool and/or on the conical threaded ring.

Furthermore, a metric threaded connection has the advantage that by a positioning of the thread flanks with respect to one another, in particular their flank angles, the conical threaded ring can be displaced on the rod in a translational manner in both directions. By contrast, with a buttress thread a displacement direction is limited to one direction. In particular, a movement only occurs in the direction in which the thread flank is inclined vertically more than approximately 30°, in particular approximately 30° to approximately 60°, with respect to the longitudinal direction of the rod.

In a further embodiment, it is provided that a minor external diameter of the conical threaded ring is arranged in the direction of the at least one blade of the cutting tool. In particular, the outer diameter of the conical threaded ring, or as the case may be, the internal diameter of the recess of the cutting tool, tapers in the direction of the at least one blade, more preferably in the direction of a coupling component.

In a further embodiment, it is provided that the conical threaded ring is pressed into the recess such that said ring can be displaced on the external thread of the rod in the longitudinal direction by means of a force.

In the event of an accident, for example, an overload is applied to the pressure plates. The force is, in particular, directed from a pressure plate into the rod, which more preferably is pushed through the recess of the cutting tool or of the conical threaded ring, wherein the cutting tool removes a chip from the rod. The conical threaded ring is preferably arranged such that when overloaded it is held by the conicity of the cutting tool. Preferably, when overloaded the threads slide over each other so that the conical threaded ring expands and, in an embodiment, allows the rod thread-turn by thread-turn through the recess, in particular until the conical threaded ring or the internal thread of the conical threaded ring is destroyed or the external thread of the rod is pushed out of the conical thread.

In particular, the rod is displaced with respect to the conical threaded ring if a force of at least approximately 700 kN to approximately 4000 kN, preferably at least approximately 800 kN to approximately 3000 kN, is applied to it. In an embodiment, it is provided that the conical threaded ring is displaced on the rod in the direction of an opposing pressure plate. In a further embodiment, it is provided that the rod is displaced in the direction of the pressure plate which is assigned to the conical threaded ring. In particular, the rod is pushed through the conical threaded ring and through a recess in the pressure plate.

The articulated coupling according to the invention has the advantage that the cutting tool is only used when a predefined overload is reached, with which it may reasonably be expected that an accident has occurred, and only if the overload of the rod is exceeded is the rod displaced relative to the conical threaded ring in order to then perform a deformation work on the rod by means of the blades.

Furthermore, a conical threaded ring comprising an internal thread and a conical external surface is proposed, wherein the conical threaded ring has a slit in its longitudinal direction. In particular, the slit is designed such that the conical threaded ring is expandable. Preferably, the slit extends over the complete longitudinal extension of the conical threaded ring, in particular from a base surface to a top surface of a truncated cone enclosing the conical threaded ring. The slit is preferably designed radially. In a further embodiment, it is provided that the slit is designed along a secant of a cross-section of the conical threaded ring. The conical threaded ring is preferably realized such that it has an expandable design. The slit preferably has a width of approximately 0.5 mm to approximately 3 mm, preferably approximately 1 mm to 2 mm.

The internal thread is preferably a V-thread or a buttress thread. In an embodiment of the conical threaded ring it is provided that the internal thread is metric.

Furthermore, a method for producing a mounting of a cutting tool, which mounting can disengage upon overload, on a tension-transferring and/or compression-transferring rod is proposed. The method comprises the steps Providing the rod with an external thread, Introducing the rod into a conical recess of the cutting tool, Screwing a conical threaded ring with an internal thread onto the external thread of the rod so that a conical external surface of the conical threaded ring comes into contact with the conical recess of the cutting tool, Introducing the rod into a pressure plate.

In a preferred embodiment, the cutting tool is pressed into the pressure plate. In a further embodiment, it is provided that cutting tool and pressure plate form a stem part which is mounted after being joined with the rod. The stem part is press-fitted with the rod. In particular, the at least one blade which comprises the cutting tool is at least partially pressed into a material of the rod. In a further embodiment, it is provided that the conical threaded ring is screwed onto the rod and into the recess of the cutting tool with a torque of approximately 100 Nm to approximately 500 Nm.

In a further embodiment, it is provided that individual or all method steps are provided in an interchangeable order. For example, it is provided in an embodiment that a rod is provided with an external thread before the cuffing tool is introduced into the pressure plate. In a further embodiment, it is provided that the joining of the cutting tool with the rod and the introduction of the cutting tool into the pressure plate essentially takes place in one operation.

Furthermore, a method for the conversion of energy by means of an articulated coupling comprising at least one pressure plate comprising a cutting tool is proposed, wherein the cutting tool comprises at least one blade and a central conically shaped recess. The articulated coupling further comprises a conical threaded ring comprising an internal thread and is slit in a longitudinal direction. The rod comprises an external thread onto which the conical threaded ring is screwed, and wherein the cutting tool is arranged on a conical external surface of the conical threaded ring, wherein the conical threaded ring is at least partially pressed into the conically shaped recess. In the case of an overload force being applied to the pressure plate, said plate is displaced on the rod, wherein the conical threaded ring is expanded and displaced translationally on the external thread.

In an embodiment, it is provided that upon the conical threaded ring being displaced on the external thread, the flanks of the internal thread are displaced over the flanks of the external thread.

The conical threaded ring is preferably expanded by means of a translational displacement of the thread flanks of the internal thread of the conical threaded ring on the thread flanks of the external thread of the rod. More preferably, the threaded ring on the rod is gradually displaced thread-turn by thread-turn in the longitudinal direction of the rod, in particular until the external thread of the rod and/or the internal thread of the conical threaded ring is destroyed or the conical threaded ring of the external thread of the rod is pushed down.

For example, an overload caused by an accident is applied to the rod by a railcar body via a first pressure plate. The reaction force is applied accordingly to the rod by a second pressure plate, preferably via rubber buffers and at least via the cutting tool and the conical threaded ring. If the force of the overload is sufficiently strong, the cutting tool is displaced over the rod, wherein said rod is displaced in particular by the rubber buffer. In particular, a chip is removed by means of the cutting tool. In a preferred embodiment, when the cutting tool is displaced on the rod, the conical threaded ring remains essentially in its originally mounted starting position. More preferably, the cutting tool disengages itself from the conical threaded ring when the overload is applied to said tool. In a further embodiment, it is provided that the rubber buffer is deformed at least by the conical threaded ring during the displacement of the cutting tool. In a further embodiment, the stroke of the rubber buffer, or as the case may be, of the cutting tool, is restricted by the conical threaded ring. In a further embodiment, it is provided that when a specific force is applied, in particular when a specific threshold value is exceeded, by the rubber buffer on the conical threaded ring, the thread flanks of the external thread of the rod and the thread flanks of the internal thread of the conical threaded ring are displaced translationally over each other. The conical threaded ring expands upon this displacement. A part of the energy introduced by the overload is converted by the in particular elastic deformation of the conical threaded ring and the friction of the thread flanks against each other. After the conical threaded ring and rod are displaced with respect to each other by a height of a thread turn, the conical threaded ring essentially springs back into its original form. If the force after displacement continues to be so great that the thread flanks can be slid over one another, the conical threaded ring expands thread-turn by thread-turn and is displaced relative to the rod, until said rod is pushed down by the external thread of the rod, or at least one of the threads is destroyed. In this way, a further stroke of the cutting tool is ensured on the rod. Preferably, with a further stroke an energy conversion occurs by dint of the removal of the chip by means of the cutting tool, and the displacement of the conical threaded ring occurs on the external thread of the rod.

In a further embodiment, it is provided that upon displacement of the pressure plate with the cutting tool the at least one blade removes a chip from the rod.

Figure 2:
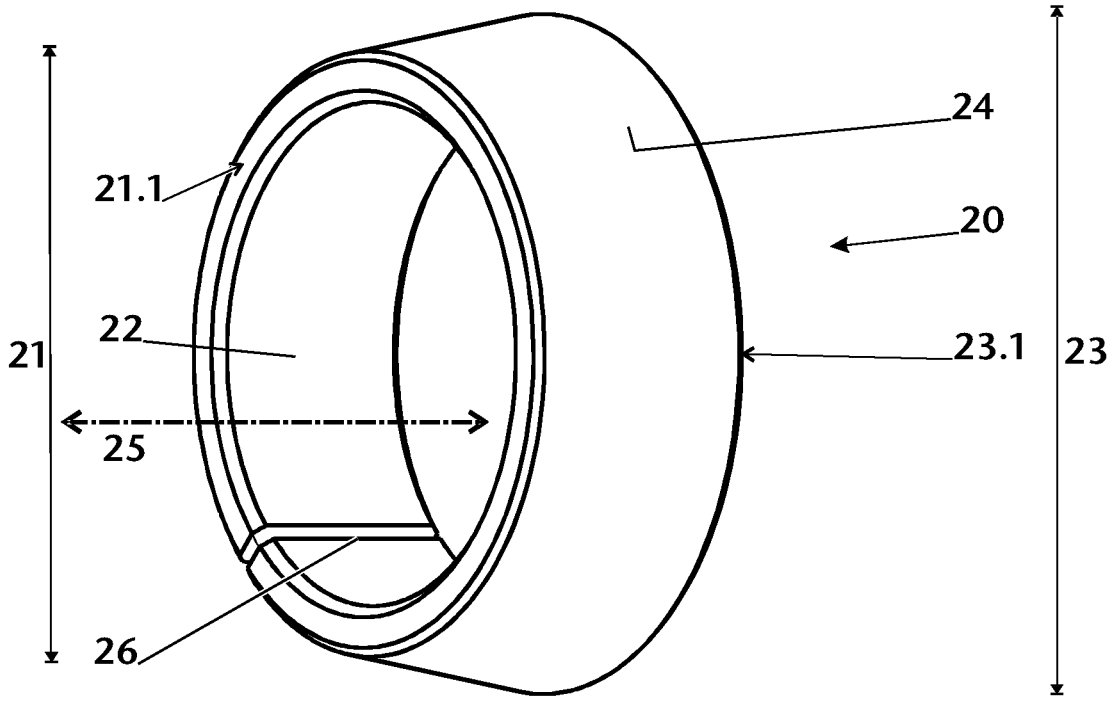
Figure 3:
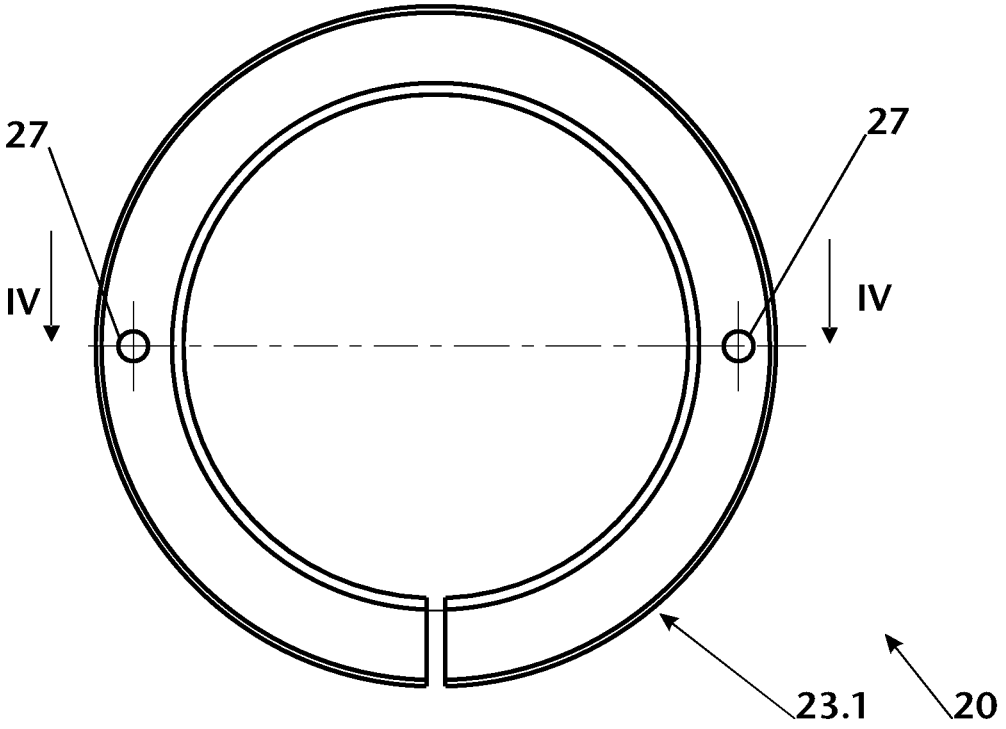
Figure 4:
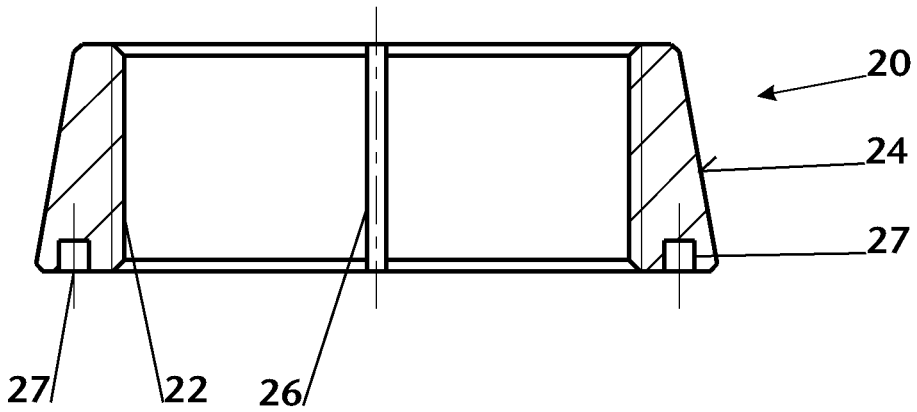
Figure 5:
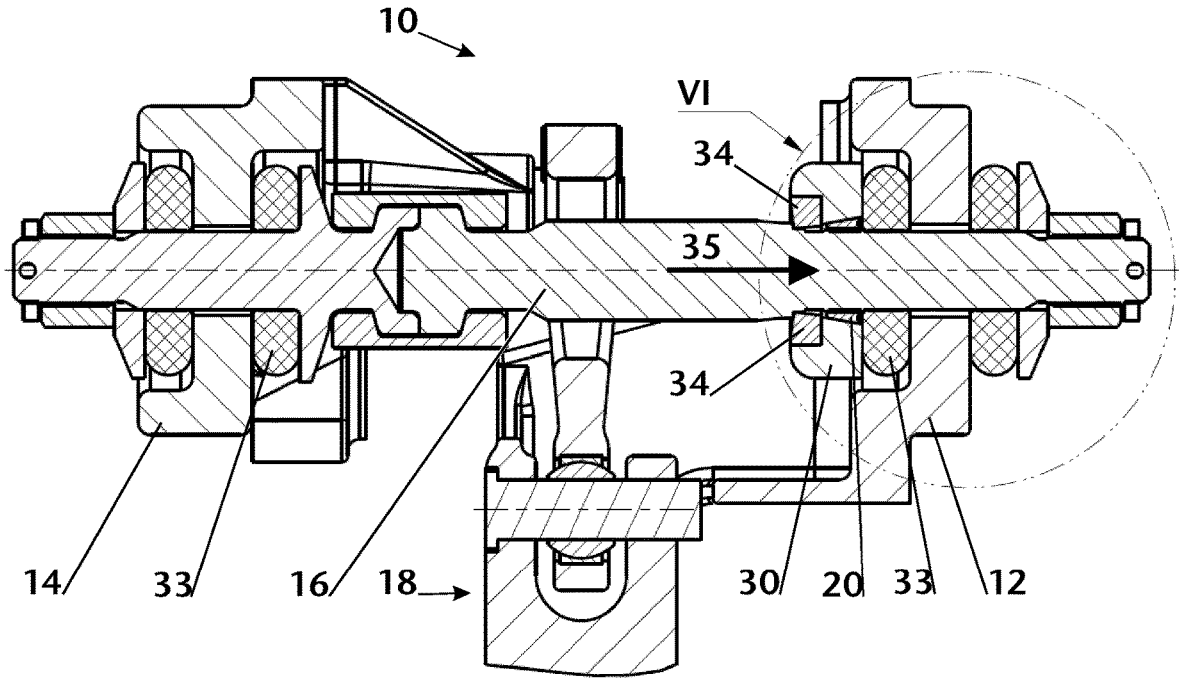
Figure 6:
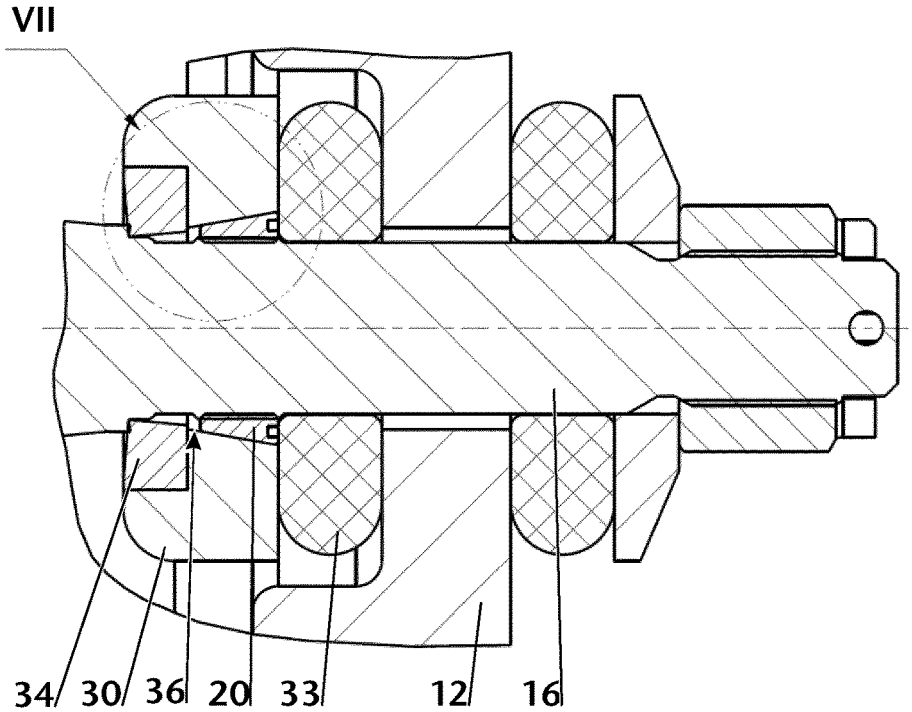
Figure 7:
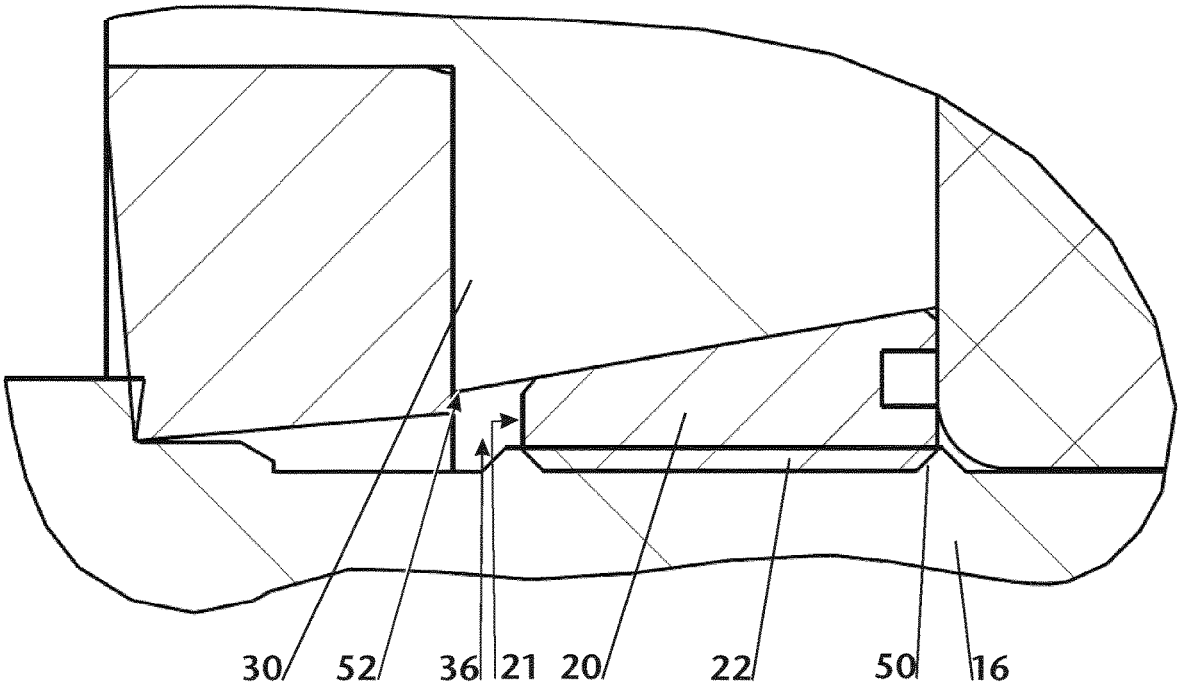
Figure 8:
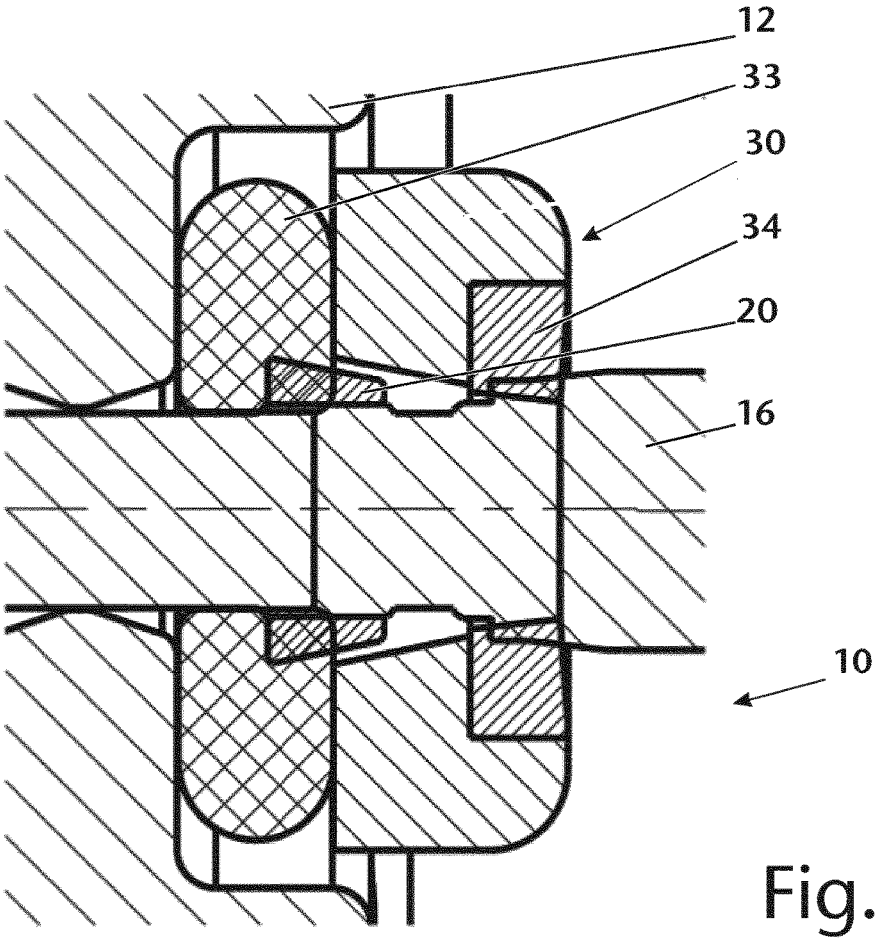

Additional advantageous embodiments arise from the following drawings. However, the developments presented there are not to be construed as limiting; rather, the features described there may be combined with one another and with the features described above to form additional embodiments. Furthermore, it is to be noted that the reference characters indicated in the figure description do not limit the protective scope of the present invention, but rather merely refer to the exemplary embodiments shown in the figures. Identical parts, or parts having the same function, have the same reference characters in the following. Shown are:

FIG. 1 a perspective view of an articulated coupling;

FIG. 2 a conical threaded ring;

FIG. 3 a top view of the conical threaded ring;

FIG. 4 a sectional view IV-IV from FIG. 3;

FIG. 5 a longitudinal section through the articulated coupling according to FIG. 1;

FIG. 6 the detailed view VI according to FIG. 5;

FIG. 7 the detailed view VI according to FIG. 6;

FIG. 8 a detailed view of the articulated coupling in the event of an accident.

FIG. 1 shows a perspective view of an articulated coupling 10 comprising two opposing connection plates 12 and 14, which are attachable to railcar bodies of a rail vehicle.

The articulated coupling 10 furthermore comprises a rod 16, which connects the connection plates 12 and 14 to each other. The articulated coupling further comprises a coupling component 18, for example a coupling component 18 of a Jacobs bogie (not shown).

FIG. 2 shows a conical threaded ring 20 having a minor diameter 21, which is assigned to a top surface 21.1, and a major diameter 23 opposed in a longitudinal direction 25, which is assigned to a base surface 23.1. The conical threaded ring 20 further has an internal thread. The external surface 24 of the conical threaded ring 20 is designed to be conical in a longitudinal direction 25 and essentially smooth or unprofiled. Furthermore, the conical threaded ring 20 has a radial slit 26 which extends over the complete length 25 of the conical threaded ring 20. The slit 26 permits an expansion of the conical threaded ring 20.

FIG. 3 shows a top view of the base surface 23.1 of the conical threaded ring 20. Two handling openings 27 can be seen with which a tool (not shown) may engage in order to mount the conical threaded ring 20 on the rod 16.

FIG. 4 shows a section IV-IV from FIG. 3. The conical threaded ring 20 can be seen having the continuous slit 26, the handling openings 27, as well as the conical outer surface 24. Furthermore, it can be seen in FIG. 3 that the conical threaded ring 20 comprises a metric internal thread 22.

FIG. 5 shows a longitudinal section of the articulated coupling 10 in an intended operation. The connection plates 12 and 14 are connected to one another by means of a rod 16, wherein the rod 16 is bifurcated in the embodiment shown. A cutting tool 30 is arranged on the rod 16, which tool has blades 34. The cutting tool 30 is mounted on the rod 16, pressed into the connection plate 12 and additionally secured on the rod 16 by means of the conical threaded ring 20. With tensile and compressive loads, forces are transferred to the rod 16 by the connection plate 14 via the rubber buffers 33, which dampen smaller impacts. Forces applied to the connection plates 12 are transferred to the rod 16 via the rubber buffers 33, the cutting tool 30 and the conical threaded ring 20. If, for example, in the event of an impact the connection plate 12 is pushed in the direction 35 of the cutting tool 30 with a force greater than approximately 1500 kN, the rod 16 is pushed through a conical recess 36 identified in FIG. 6, which recess the cutting tool 30 completely passes through. An external thread 50 of the rod 16 identified in FIG. 7 slides over the internal thread 22 of the conical threaded ring 20, wherein said ring thereby expands due to the slit 26. As a result, the rod 6 can move relative to the cutting tool 30. By means of the blades 34, at least one chip (not shown here) is thereby removed in each case from the rod 16. By dint of this deformation work performed by the cutting tool 30, an energy conversion is completed which converts the kinetic energy into thermal and deformation energy. By contrast, smaller impacts are absorbed during normal operation by means of the rubber buffers 33 and do not result in the threaded connection disengaging from the rod 16 and the conical threaded ring 20.

FIG. 6 shows a detailed view VI from FIG. 5 in an intended operation. It can be seen that the conical threaded ring 20 is arranged in a recess 36 of the cutting tool 30. The blades 34 of the cutting tool 30 touch the rod 16. Furthermore, it can be seen that the connection plate 12 can act on the cutting tool 30 via the rubber buffer 33.

FIG. 7 shows a detailed view VII from FIG. 6 in an intended operation. From this it can be seen that the conical threaded ring 20 is arranged in the recess 36 of the cutting tool 30 such that the conicity of the recess 36 and of the conical threaded ring 20 is the same, wherein a minor diameter 52 of the recess is smaller than the minor diameter of the conical threaded ring. In a further embodiment, not shown here, it is provided that the minor diameter 52 of the recess 36 is essentially the same size as the minor diameter 21 of the conical threaded ring 20. The external diameter 20 and the recess taper in the direction of the blades 34. In this way, it is possible for the conical threaded ring 20 to be pressed into the cutting tool 30, wherein a pretensioning of the conical threaded ring 20 may be produced and, therefore, a force-fitting connection is created between the conical threaded ring 20 and the cutting tool 30. Furthermore, it can be seen from FIG. 7 that the external thread 50 of the rod 16 interacts with the internal thread 22 of the conical threaded ring 20.

FIG. 8 shows as an example a detailed view of the articulated coupling 10, with which an overload, caused by an accident, is applied to the rod 16 by a railcar body via a first pressure plate 12. The reaction force is applied accordingly to the rod 16 by a second pressure plate, preferably via the rubber buffer 33 and at least via the cutting tool 30 and the conical threaded ring 20. If the force of the overload is sufficiently strong, the cutting tool 30 is displaced over the rod 16, wherein said rod is displaced in particular by the rubber buffer 33. In particular, a chip (not shown here) is removed by means of the blades 34, which is indicated by the intersection of the blades 34 with the rod in FIG. 8. Upon displacement of the cutting tool 30 on the rod 16, the conical threaded ring 20 essentially remains in its originally mounted starting position. The cutting tool 30, by dint of the application of the overload to the same, is pushed down by the conical threaded ring 20. The rubber buffer is deformed at least by the conical threaded ring during the displacement of the cutting tool, which is indicated in FIG. 8 by the intersection of the conical threaded ring 20 with the rubber buffer 33. In particular, the stroke of the rubber buffer or, as the case may be, of the cutting tool, is restricted by the conical threaded ring.

In FIG. 8 it cannot be seen that when a specific force is applied, in particular when a specific threshold value is exceeded, by the rubber buffer 33 on the conical threaded ring 20, the thread flanks of the external thread of the rod 16 and the thread flanks of the internal thread 22 of the conical threaded ring 20 are displaced translationally over each other. The conical threaded ring 20 expands upon this displacement. A part of the energy introduced by the overload is converted by the in particular elastic deformation of the conical threaded ring 20 and the friction of the thread flanks over each other. After the conical threaded ring 20 and rod 16 are displaced with respect to each other by a height of a thread turn, the conical threaded ring 20 essentially springs back into its original form. If the force after displacement continues to be so great that the thread flanks can be slid over one another, the conical threaded ring 20 expands thread-turn by thread-turn and is displaced relative to the rod 16, until said rod is pushed down by the external thread 50 of the rod 16, or at least one of the threads 22, 50 is destroyed.

With the proposed conical threaded ring 20, which is installed in the articulated coupling 10, and the proposed method, it is advantageously possible to ensure a further stroke of the cutting tool 30 on the rod 16. In particular, with the further stroke an energy conversion occurs by dint of the removal of a chip by means of the cutting tool 30, and the displacement of the conical threaded ring 20 occurs on the external thread 50 of the rod 16.

The invention claimed is:

1. An articulated coupling comprising:

at least one tension-transferring and/or compression-transferring rod;

at least one pressure plate comprising a cutting tool, which comprises at least one blade and a central conically shaped recess; and at least one conical threaded ring, which comprises an internal thread and is slit in a longitudinal direction, wherein the rod comprises an external thread onto which the conical threaded ring is screwed, the cutting tool is arranged on a conical external surface of the conical threaded ring, and the conical threaded ring is arranged at least partially in the conically shaped recess.

2. The articulated coupling according to claim 1, characterized in that the external surface of the conical threaded ring and the recess of the cutting tool essentially have an identical conicity.

3. The articulated coupling according to claim 1, characterized in that the internal thread of the conical threaded ring is metric.

4. The articulated coupling according to claim 1, characterized in that a minor external diameter of the conical threaded ring is arranged in the direction of the at least one blade of the cutting tool.

5. The articulated coupling according to claim 1, characterized in that the conical threaded ring is designed such that said ring can be displaced on the external thread of the rod in the longitudinal direction by means of a force.

6. A method for producing a mounting of a cutting tool, which mounting can disengage upon overload, on a tension-transferring and/or compression-transferring rod, the method comprising:

providing the rod with an external thread, introducing the rod into a conical recess of the cutting tool, screwing a conical threaded ring with an internal thread onto the external thread of the rod such that the conical threaded ring is displaceable on the external thread of the rod in a longitudinal direction by means of a force, introducing the rod into a pressure plate.

7. The method according to claim 6, further comprising:

displacing the conical threaded ring on the external thread such that flanks of the internal thread are displaced over flanks of the external thread.

8. The method according to claim 6, further comprising:

introducing the rod to the pressure plate such that upon displacement of the pressure plate with the cutting tool at least one blade of the cutting tool removes a chip from the rod.

9. The method according to claim 6, further comprising:

forming the at least one conical ring such that the external surface of the conical threaded ring and the recess of the cut-ting tool essentially have a substantially identical conicity.

10. The method according to claim 6, wherein screwing the conical threaded ring to the external thread of the rod comprises:

arranging a minor external diameter of the conical threaded ring in a direction of at least one blade of the cutting tool.

11. A method for conversion of energy by means of an articulated coupling, the method comprising:

providing at least one tension-transferring and/or compression-transferring rod, wherein the rod comprises an external thread;

providing at least one pressure plate, said plate comprising a cutting tool, which comprises at least one blade and a central conically shaped recess;

providing at least one conical threaded ring, which comprises an internal thread and is slit in a longitudinal direction;

screwing the external thread of the rod onto the conical threaded ring;

arranging the cutting tool on a conical external surface of the conical threaded ring; and pressing the conical threaded ring into the conically shaped recess, wherein in case of an overload force being applied to the pressure plate, said plate is displaced on the rod, and wherein the conical threaded ring is expanded and displaced translationally on the external thread.

12. The method according to claim 11, further comprising:

displacing the conical threaded ring on the external thread such that flanks of the internal thread are displaced over flanks of the external thread.

13. The method according to claim 11, further comprising:

introducing the rod to the pressure plate such that upon displacement of the pressure plate with the cutting tool the at least one blade removes a chip from the rod.

14. The method according to claim 11, wherein providing the at least one conical threaded ring comprises:

forming the at least one conical ring such that the external surface of the conical threaded ring and the recess of the cut-ting tool essentially have a substantially identical conicity.

15. The method according to claim 11, wherein providing the at least one conical threaded ring comprises:

forming the at least one conical ring such that the internal thread of the conical threaded ring is metric.

16. The method according to claim 11, wherein screwing the external thread of the rod onto the conical threaded ring comprises:

arranging a minor external diameter of the conical threaded ring in a direction of the at least one blade of the cutting tool.

17. The method according to claim 11, wherein screwing the external thread of the rod onto the conical threaded ring comprises:

screwing the external thread of the rod onto the conical threaded ring such that the conical ring is displaceable on the external thread of the rod in the longitudinal direction by means of a force.

* * * * *